US006935500B1

(12) United States Patent
Schnaars

(10) Patent No.: US 6,935,500 B1
(45) Date of Patent: Aug. 30, 2005

(54) BULK BAG WITH SUPPORT SYSTEM

(76) Inventor: Daniel R. Schnaars, 153 S. Long St., Lafayette, LA (US) 70506

( * ) Notice: Subject to any disclaimer, the term of this patent is extended or adjusted under 35 U.S.C. 154(b) by 94 days.

(21) Appl. No.: 10/310,476

(22) Filed: Dec. 5, 2002

(51) Int. Cl.[7] ..... B65D 19/00; B65D 33/02

(52) U.S. Cl. ..... 206/386; 206/599; 206/600; 383/119

(58) Field of Search ..... 206/386, 595–600; 383/119, 121–121.1, 24; 108/51.11, 55.1, 108/56.3

(56) References Cited

U.S. PATENT DOCUMENTS

| | | | | | |
|---|---|---|---|---|---|
| 2,698,696 | A | | 1/1955 | Strong | |
| 4,364,424 | A | * | 12/1982 | Nattrass | 383/24 |
| RE32,308 | E | * | 12/1986 | Nattrass | 383/24 |
| 4,830,191 | A | | 5/1989 | Dijksman | |
| 5,465,865 | A | | 11/1995 | Coombes | |
| 5,507,237 | A | | 4/1996 | Barrow et al. | |
| 5,613,447 | A | | 3/1997 | Trickett | |
| 5,785,175 | A | | 7/1998 | Cholsaipant | |
| 6,213,305 | B1 | * | 4/2001 | Baker et al. | 206/599 |
| 6,390,675 | B1 | | 5/2002 | Jardine | |
| 6,467,625 | B2 | * | 10/2002 | Baker et al. | 206/599 |

* cited by examiner

*Primary Examiner*—Bryon P. Gehman
(74) *Attorney, Agent, or Firm*—Garvey, Smith, Nehrbass & Doody, L.L.C.; Gregory C. Smith

(57) ABSTRACT

An improved fabric bulk bag with pallet combination, of the type having wall portions, a top portion, and a floor portion, all defining a space for storing bulk therein, and in a first embodiment providing a pair of channels, substantially parallel in relation, secured along the outer surface of the floor portion, each channel having two open ends; a substantially elongated rigid support member insertable into each channel, for receiving the tines of a forklift, while providing a stable pallet foundation for the bag when the bag is positioned atop another filled bag. A bulk containing portion of the floor of the bag extending between the two support members when the bag has sufficient bulk, so that the portion filled with bulk defines a continuous support surface between the two support members and together define a continuous support across the floor of the bag.

21 Claims, 12 Drawing Sheets

BULK BAG WITH SUPPORT SYSTEM

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The apparatus of the present invention relates to fabric bulk bags, also known as Flexible Intermediate Bulk Containers, and how these bags are handled. More particularly, the present invention relates to a bulk bag having a floor portion which includes a pair of spaced apart pockets for receiving a rigid member to define a channel through which tynes of a forklift may enter, and a portion of the floor extending between the pockets to define a support surface together with the rigid members.

2. General Background of the Invention

Bulk bags are for the most part bags constructed of a polypropylene material which would normally be of the type having four side walls, a bottom wall, a top wall and means such as loops for lifting the bag with a forklift after the bag has been loaded with bulk. The prior art bulk bags utilized the lifting loops at each corner in order to lift the loaded bag, which may weigh thousands of pounds, so that the filled bags may be stored in a warehouse or the like. Lifting loops are difficult to access by a forklift and usually takes a second person to assist. A second issue is the height needed to work with the bags when lifting from above. When filled, bulk bags may also be moved on pallets. Pallets, although easily accessible, are usually made of wood, and over time will be susceptible to splintering, mold, or insects.

The wood pallet solves those two problems but, as is often the case, created new problems to be overcome. The wooden pallet is heavy. This has caused many back and finger injuries. It also uses up valuable load limit during shipping. Pallets often weigh between 30 and 70 pounds each. A standard truckload of products will use 22 of these pallets which adds nearly three-quarters of a ton of weight to the total load. A reduction of this weight increases the amount of actual product that can be shipped each time. Another issue with the wooden pallet is the disposal issue. The pallet consists of wood and nails and any chemical residues that it picks up during the transport. This makes the disposal of these pallets quite expensive. The wood can contaminate the products it transports by shedding splinters which penetrate into the bags. In short, it is desirable to find an alternative to wooden pallets for the transportation of these bags. Plastic pallets may eliminate these problems, but are very expensive to produce.

One problem with transporting and storing bags of this type is that the bags, in order to conserve space, would typically be stacked upon one another to a height, so long as the bags did not risk of toppling over. However, because of the soft underside of the bags, when the bags, filled with dry, powdery bulk, are stacked upon one another, the bulk within the bag may shift, and in doing so, may cause the bag to lose its center of gravity and fall from its resting place, which could be both dangerous to persons working in the area, and cause the loss of thousands of pounds of what may be expensive bulk material.

There have been several attempts by past inventors to resolve these issues but each invention has fallen short of meeting the market's needs. U.S. Pat. No. 4,830,191 discusses the idea of using two tubular shaped objects to provide fork tine access under the bag. The patent further teaches that the bag should reach the floor rather than to ride above the fork tines. But, this patent left three important features unsolved. One, there is no connection of the bag to the pallet tubes. This allowed for independent movement which created the possibility for the bags to slip off during braking of the fork lifts. Second, the method for bringing the bag to the floor involved many layers of fabric. This made this invention very expensive and prevented the bag from having a bottom discharge. Bottom discharges are important to bulk bags as it provides for the easy emptying of the bags. In today's marketplace, cost plays a very important factor as well. Third, the invention could not travel down roller conveyors. This is due to the soft bottom of the invention. This soft bottom would form itself around the tops of the conveyor rollers and prevent movement along such conveyors. As many companies use such type of conveyor, this became a major problem for general acceptance.

A second notable attempt to provide bulk bags that could be handled from below without wooden pallets was made in U.S. Pat. No. 5,785,175 teaches how to shape a bag bottom so that no tubes are needed. It provided bag structure that provided a base to the floor for only a portion of the bag's total bottom. The other portion of the bottom then stood above the floor, providing a place for forklift tines to reach under those portions for lifting. In fact, a goal of this patent was to accomplish the transporting job without anything other than the bag. While the methods work mostly with the bottom portion of the bag that reaches the floor, in reality, it became necessary to use this only with a special type of bulk bag called a baffle bag. The patent also failed to meet general market needs due to three particular insufficiencies. One, the structure within the base portion of the bag, exists within the product storage area. This provides many opportunities for product contamination and prevents the use of a polyethylene liner. The liner is commonly used for any type of sensitive products such as food or pharmaceuticals. A second problem with this approach was the intended lack of support under the overhanging portions of the bag. While these do work as intended, meaning that the bag does not sag into the area and block forklift access, it added a new failing to the package. This lack of support in the outer 8 inches of the bag translated into very small bottom portions that the larger upper bag portions had to 'balance' on. This bag exhibited a reduced amount of stability when placed on the floor and a definite instability when double-stacked. The third insufficiency was, again, the inability to travel down roller conveyors due to the soft bottom.

A more recent attempt to improve the usability of alternatives to wood pallets is shown in U.S. Pat. No. 6,213,305. This patent attempts to resolve the problem of holding the tubes to the bag, or in reverse, to hold the bag to the tube. However, in this patent, the tube is still expected to carry the entire load again. Therefore the plastic must be of sufficient strength and thickness to manage that.

In another effort to attempt to solve the problem, reference is made to U.S. Pat. No. 6,213,305, entitled "Bulk Bag," which disclosed the use of two rigid members placed within sleeves on the bottom of the bag, the rigid members formed to receive tynes of a forklift through the opening formed by the members. The members were secured within the sleeves with elastic bands. This attempt has fallen short of solving the problems in several reasons. First, the elastic bands need sufficient tension to hold the rigid members within the channel, which is difficult. Also, the rigid members, if not properly secured within the channels will tend to slide from the channels when the tynes of the forklift go into or out of the sleeves. Also, plastic inserts, which have been provided which are thick, extruded plastic, rectangular tubes. Such four-sided tubes cannot be nested when shipped or stored. Additionally, the rigid inserts do not provide any protection to the sleeves making direct contact with the floor where a bag may be slid along the floor, thus wearing or even tearing the sleeves on the bottom of the bag.

Therefore, there is a need for improving the art of inserts into channels on the floor of bulk bags which solves these aforesaid problems. What is needed is a straight forward solution that takes into account all parts of the application to provide a successful system that answers the usage shortfalls discussed above yet also answers the economic requirement for low cost replacements of the wooden pallet. Further this invention must work with low cost bags rather than only the expensive baffle types of bags.

Applicant is submitting herewith the prior art statement regarding patents which have been reviewed which may be pertinent to the subject matter of this invention.

SUMMARY OF THE PRESENT INVENTION

This inventor has done many tests to determine not only the solutions to the problems already known but to provide solutions to currently unstated problems that are anticipated with the introduction of new products. In all of the patents discussed above, it appears that each inventor has considered the needs of the bag or the needs of the pallet portions individually. It does not appear that anyone has considered combining the needs to eliminate overlapping costs and performances for the most economical and straightforward solutions. It is in this type of thinking that uncovered the proposed inventions. This invention proposes to solve the issues discussed above by considering the pallet and bag to be a single unit. This invention involves a bag design that brings the product to the floor in a manner that allows for an unencumbered product storage area and the use of a discharge spout. The portion of the bag that drops down to meet the floor is of sufficient size to support at least 40% of the entire bag's weight. This leaves only 30% of the total weight to be supported by each plastic tube. When this is taken into consideration, then the plastic tube can be drastically reduced in strength and cost. Since the tubes support the bag all the way to the edges, the stability of the bag is greatly increased over the Cholsaipant patent.

However, while testing of this idea proved that it can be accomplished, two new problems were encountered. The drop down portion of the bag that comes into contact with the floor is now in contact with contamination that can endanger the product during the discharging operation. Further, the drop down portion can be damaged if the bag is slid along the ground as often happens. This is solved with a unique cover flap that is very economical as it covers only the area between the plastic tubes.

Another problem that is encountered with this invention is the inability of the bag/pallet system as described to travel consistently down roller type conveyors. This problem is not inherently necessary for all situations as not all companies use roller conveyors. However, for those that do, the problem must be resolved as the lower portion of the bag tends to shape itself around the tops of each roll and prevent the bag from moving along the conveyor.

The present state of the art is to put the bag and pallet tubes onto another wooden pallet to accomplish this requirement. This defeats the whole purpose of this invention. In another form, the pallet tubes have been connected with a sheet of plastic at the top to form a traditional pallet. Again, this require full strength in the plastic which results in high cost. Recently, some companies have connected the pallet tubes with a sheet at floor level. This has not yet been done in conjunction with a bag designed to drop to floor level as we have suggested here, but even ignoring this combination, the connecting of the pallet tubes to the flat sheet has high cost due to the size of the mold and it eliminates any economical method of attaching the pallet tubes to the bag.

In the proposed invention, we teach a 'floating sheet of hard material, preferably plastic, that will cover any area of contact between the bag and the floor level. This will perform several functions. It will protect the bag bottom from damage. It will protect the bag bottom from dirt. It will provide a platform that will allow the bag to travel down roller conveyors. It will provide for low cost as it can be produced in the lowest cost methods such as extrusion versus the high cost of large injection molding processes.

Another problem encountered in the use of pallet tubes is determining the length of such tubes. Naturally, the length relates to overall cost. The current standard in the market place seems to be 48 inches for this type of tube. This size has been promoted due to the potential for the bag to sag around the base. A 37 inch by 37 inch bag can round out into a circle of 47 inches. This sagging can then allow the bag fabric to cover part of the opening for the fork times and cause damage. To eliminate this, the market is currently using the 48 inch long tubes.

In this invention, the bottom of the bag is intentionally restricted to prevent the bag from sagging toward the open ends of the tubes. This is allowing for the safe use of tubes that are only 42 inches long. This has again, increased the economies of this design.

In summary, what is provided is an improved fabric bulk bag, of the type having wall portions, a top portion, and a floor portion, all defining a space for storing bulk therein, and in a first embodiment providing a pair of channels, substantially parallel in relation, secured along the outer surface of the floor portion, each channel having two open ends; a substantially elongated rigid support member insertable into each channel, the upper wall of the member contacting the outer surface of the bulk bag, and the two arms of the U-shaped member providing a travel space through the channel for receiving the tynes of a forklift, and allowing the tynes to contact the upper wall of the member when the bag is lifted; the two arms of the support member also providing a stable pallet-like foundation for the bag when the bag is positioned atop another filled bag. There is further provided a portion of the floor of the bag extending between the two support members when the bag has sufficient bulk, so that the portion filled with bulk defines a continuous support surface between the two support members and together define a continuous support across the floor of the bag.

In a second embodiment, the support members provide an undersurface therebetween, to define a pallet member, so that the bulk bag, with the additional bulk space, when set upon the pallet member, the bulk space fills the void between the support members of the pallet member, and together define a bulk bag/pallet combination upon which the bulk bag resides.

Therefore, it is a principal object of the present invention to provide an improved bulk bag which can be easily and safely transported by forklift and safely stacked on another filled bulk bag.

It is a further principal object of the present invention to provide an improved bulk bag which includes a pallet support structure incorporated therein.

It is a further object of the present invention to provide a bottom portion of the bag adapted with rigid members for defining a level, secure means to both transport the filled bag and allow the bag to be safely stacked on other such bulk filled bags.

It is a further object of the present invention to provide support members insertable into sleeves on the bottom of a bulk bag which allows the support members to contact the surface upon which the bag rests without contacting the sleeves.

It is a further object of the present invention to provide rigid inserts for bulk bags made of high density polyethylene which can be injection molded rather than extruded plastic, to allow for geometric shaping of the insert and to use a variety of plastic materials.

It is a further object of the present invention to provide plastic inserts for bulk bags which are inexpensive to mold, and can be nested when shipped or stored.

It is a further object of the present invention to provide removable inserts which are not permanently positioned within sleeves on bag bottoms allowing the inserts to be easily positioned into and removed from the bag, do not have to be shipped with the bags, and easily removed when refurbishing of the bag is necessary.

It is a further object of the present invention to provide a bulk bag having a modified floor portion between the two plastic inserts to define a continuous support surface along the bottom of the bag when the bag is filled with bulk material.

It is a further object of the present invention to provide a flat rigid member extending across the lower portions of the rigid members to define a pallet-like structure upon which the bag would rest, with the modified floor portion nestled between the two rigid members.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 8:
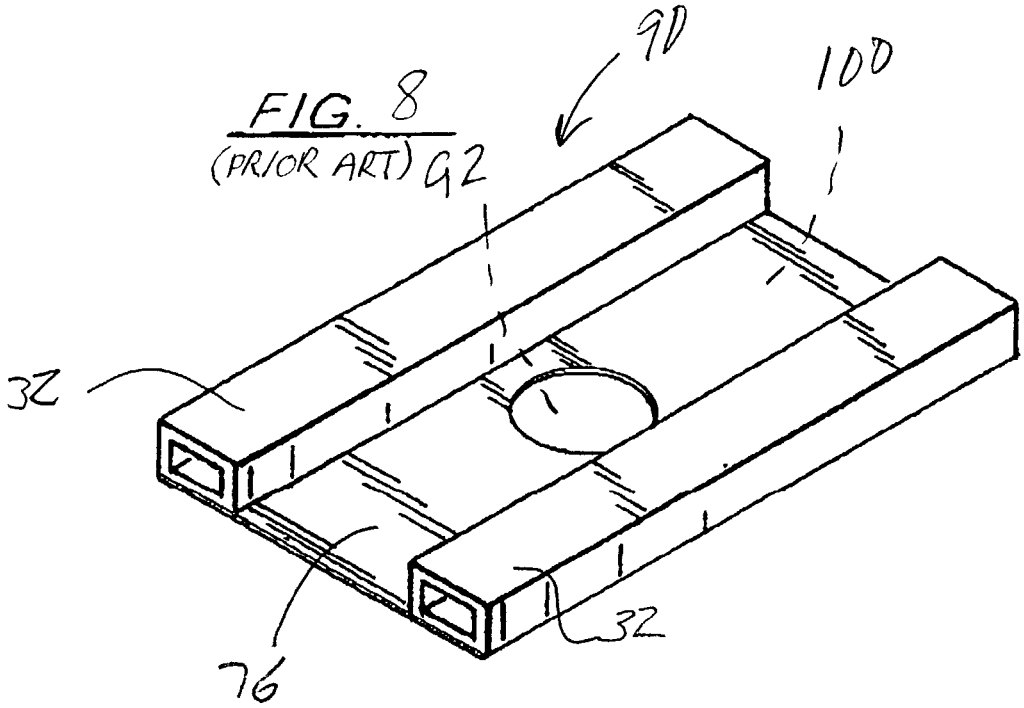
FIG. 8 (PRIOR ART)
FIGS. 8 and 9 illustrate overall views of a prior art pallet portions which may be used with the present invention.
Figure 9:
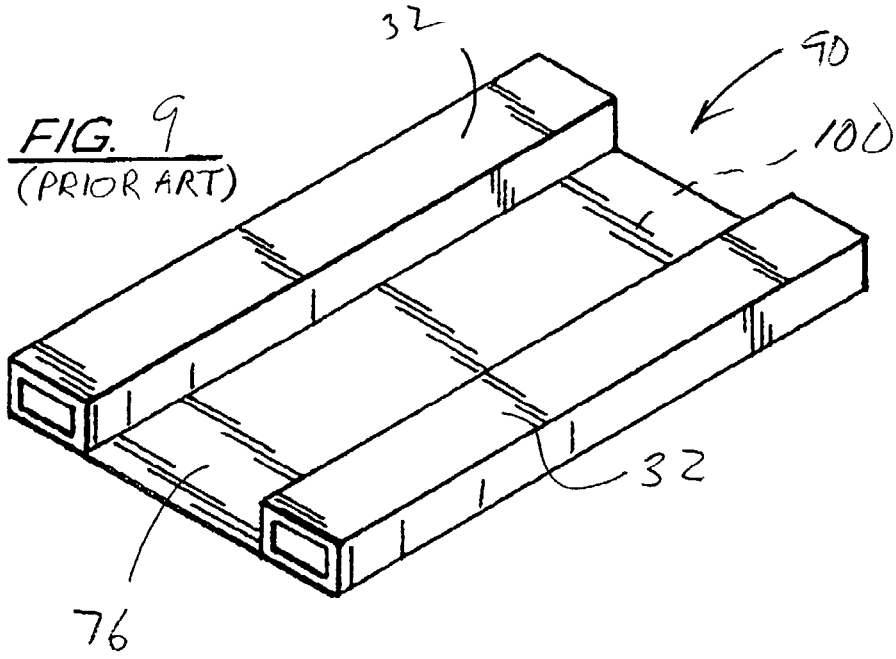
FIG. 9 (PRIOR ART)

FIGS. 1 through 7 illustrate a first preferred embodiment of the container system 10, which includes a bulk bag of the present invention incorporating a pallet feature therein. FIGS. 8 and 9 illustrate views of a prior art pallet which may be utilized with the bulk bag of the present invention as illustrated in FIGS. 1 through 7. FIGS. 11 through 23 illustrate additional preferred embodiments of the container system of the present invention.

Figure 1:
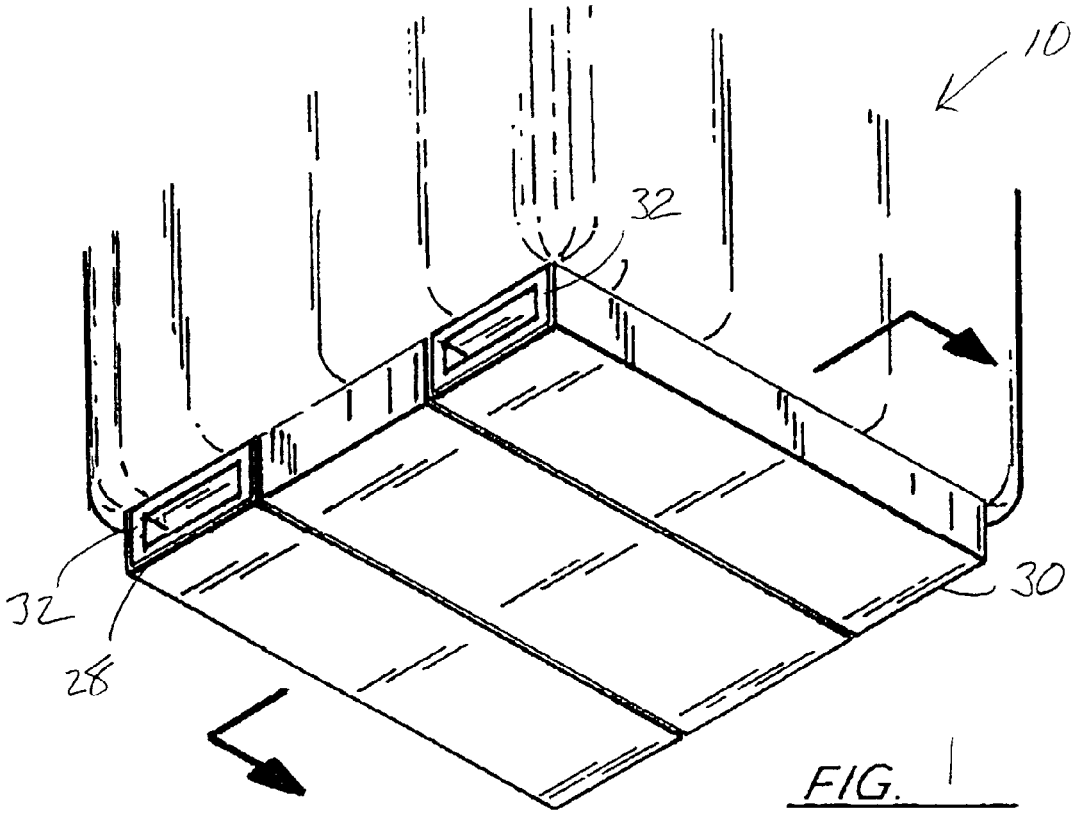
FIG. 1 illustrates an overall view of the preferred embodiment of the present invention.
Figure 2:
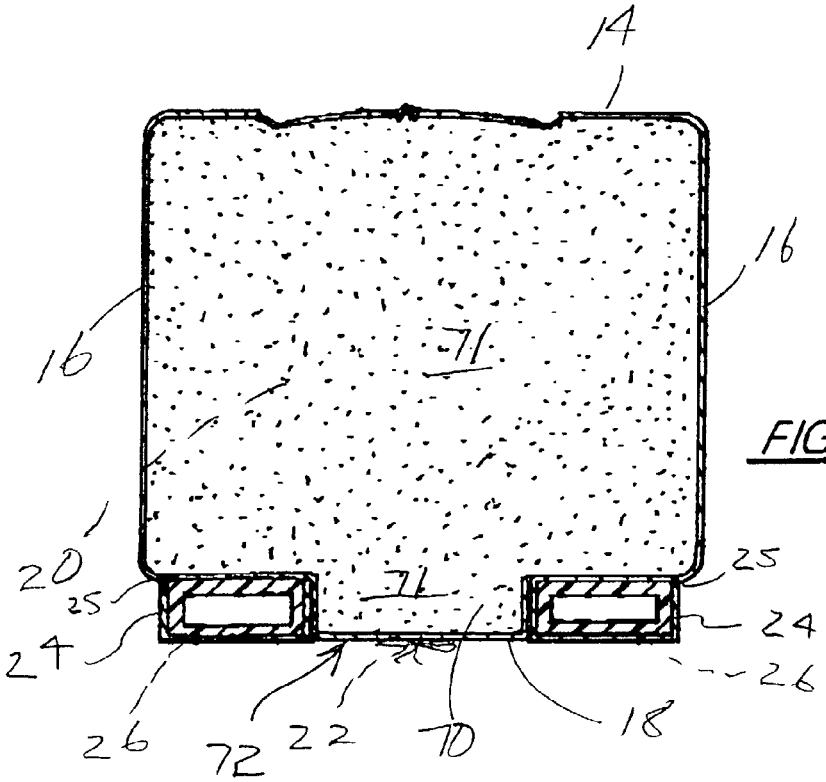
FIG. 2 illustrates a view along lines 2—2 in FIG. 1 of the preferred embodiment of the present invention.

Turning first to FIGS. 1 through 7, as illustrated in FIGS. 1 and 2, there is illustrated a fabric bulk bag 10, of the type having a top wall 14, side walls 16, and a bottom wall 18. In most cases the bulk bag 10 would have an opening in its top wall 14 through which bulk material is poured into the bag space 20, and an opening 22 on its bottom wall 18 for allowing the bulk to flow from the bag space 20, when the normally closed opening 22 is opened. The opening 22 would usually include a down spout for allowing the bulk material to flow into another vessel or the like. These features are quite common in most bulk bags.

Turning again to FIGS. 1 and 2, there is illustrated the underside or bottom wall 18 of bulk bag 10 of the present invention, which would include a pair of fabric sleeves 24 stitched, or secured in other ways, along the edges 25 so as to define an opening 26 between the sleeve 24 and the underside 18 of the bulk bag 10. As illustrated the sleeves 24 are open at their two ends 28, 30, which would allow a support member 32, as illustrated, to be slidingly engaged through the opening 26. Each support member would include an opening 35 throughout to accommodate a foklift tyne. The support members 32 may have ends 34, 36 extending beyond the ends 28, 30 of the sleeves, although this is not necessarily required. As is further illustrated the sleeves 24 are positioned substantially parallel to one another on the underside 12, and spaced sufficiently apart so, after support members 32 are in place, will allow the tynes of a forklift to slide into each support member 32 when the filled bulk bag 10 is being lifted and moved, as will be discussed further.

In a related application, owned by Ameriglobe, there is provided a detailed explanation of various types of support members 32 which could be utilized with the bulk bag of the present invention. This related application, entitled "BULK BAG PALLET TUBE APPARATUS", is incorporated herein in its entirety by reference thereto.

As seen particularly in FIG. 2, the underside 18 of bulk bag 10 is configured to define a bulk containing space 70 between the two sleeves 24, so that when receiving sufficient bulk, the bulk 71 within the containing space 70 occupies the entire space between the two sleeves 24, and further defines a continuous lower surface 72 upon which the bag rests, as defined by the two members 32 and the bulk bag space 70. As illustrated, the bottom wall 18 of bulk bag 10 has been designed to provide sufficient fabric between the two sleeves 24, so as to allow bulk within the bag to fill the entire void or space 70 between the entire length of the two sleeves 24 and perform the support function as seen in FIG. 2.

Figure 3:
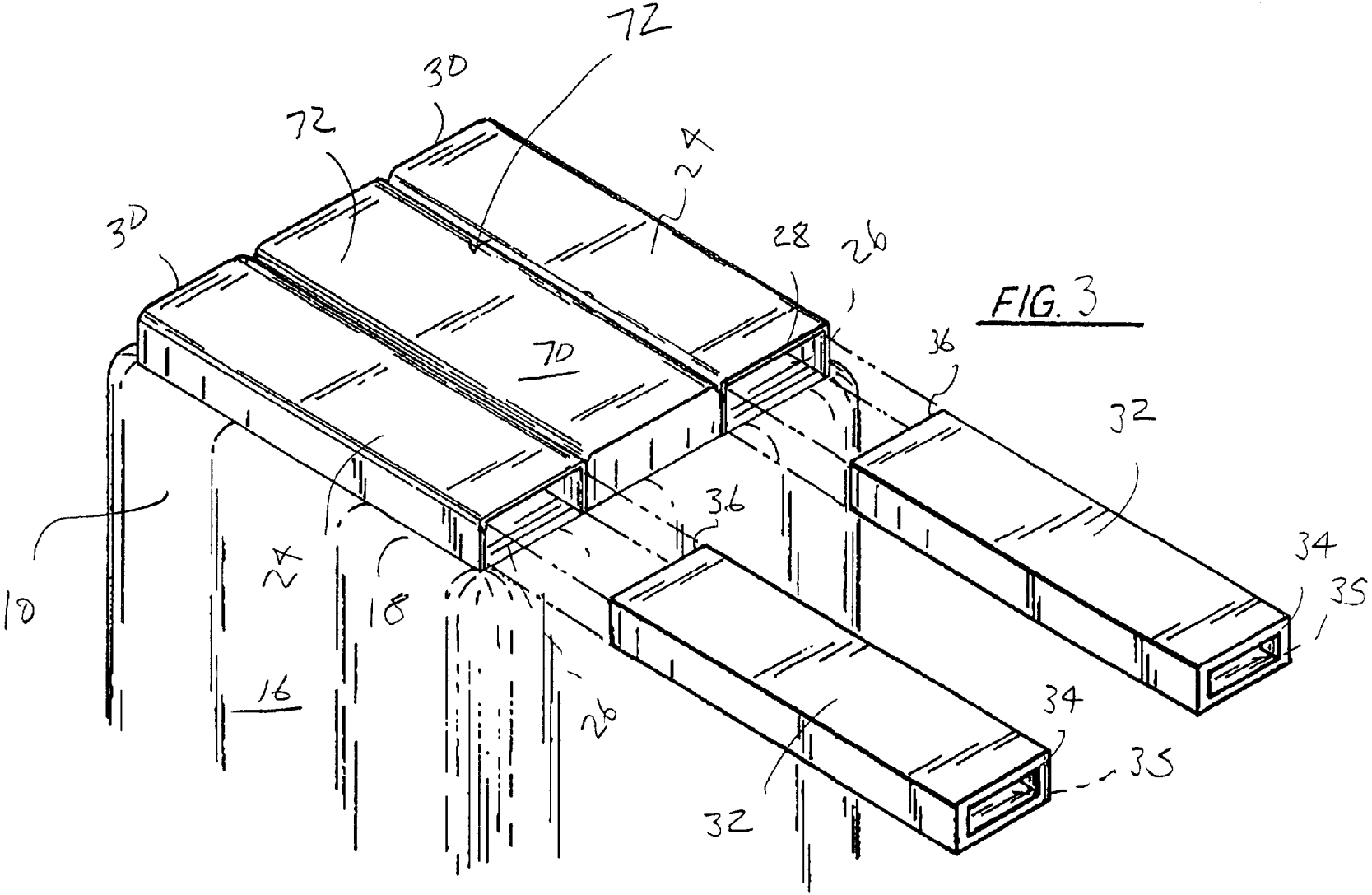
FIG. 3 illustrates an overall exploded view of the present invention.

As illustrated in FIG. 3, the support members 32 are substantially rigid, four-sided rectangular members having a space 35 therethrough for accommodating the tynes of a forklift, as described earlier. After the members 32 are slidingly engaged within sleeves 24, the two members 32 together with the bulk space 70 maintains a solid and flat support undersurface 72 extending across the entire bottom surface of the bag upon which the bulk bag rests.

Figure 5:
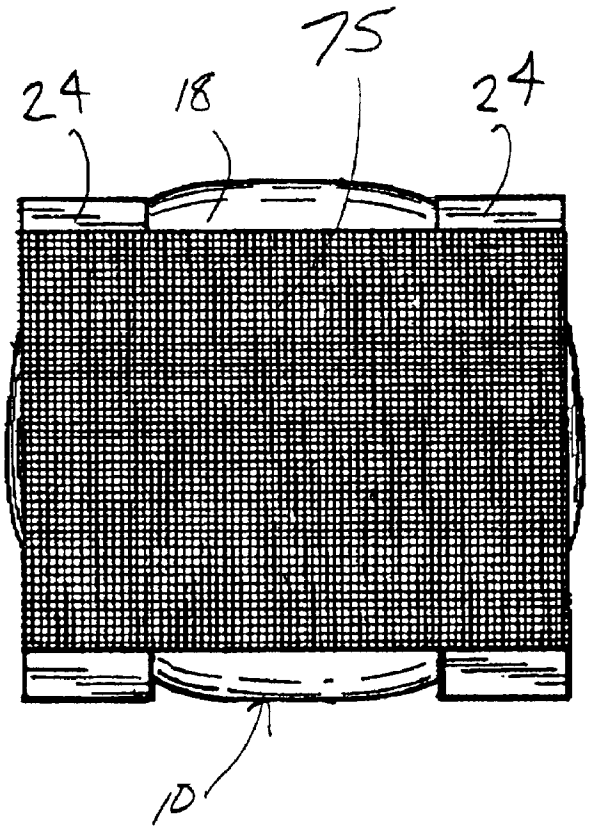
FIG. 5 illustrates an underside view of the present invention with a protective cover secured across the entire underside of the bulk bag.
Figure 4:
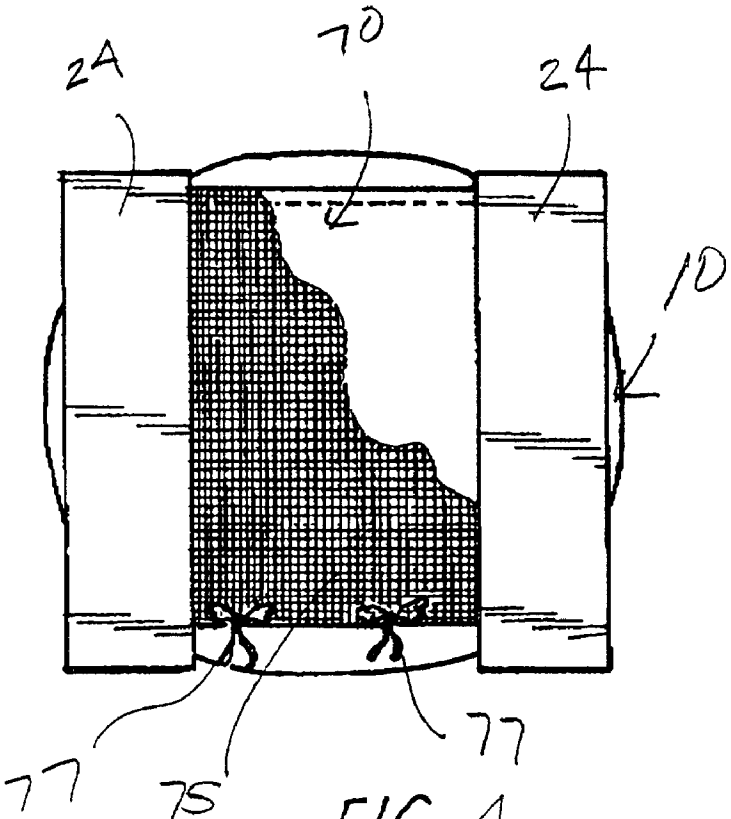
FIG. 4 illustrates an underside view of the present invention with a protective cover tied and secured across the bag portion.

FIGS. 4 and 5 illustrate additional features which may be included as part of the present invention to help maintain the bulk bag free from contamination and offer greater support. As seen first in FIG. 4, the bulk space 70 between support sleeves 24 has been provided with an underside 75, which may be rigid or flexible, but, as seen, would be tied in place to bag 10 via ties 77. This underside 75 would offer a barrier between the surface upon which the bag 10 rests and the underwall of the bulk space 70. In this embodiment the two sleeves 24 are not covered by the underside 75.

In FIG. 5, the underside 75 has been modified so that it extends across the entire underside 18 of the bag 10, including the two sleeves 24. In this embodiment the underside 75 may be secured to bag 10 in various ways, although the use of velcro to secure the undersurface 75 to the bag 10 would be preferred. In this embodiment there is no direct contact between any portion of the bulk bag underside 18 and the surface upon which the bag rests. Also, depending of the rigidity of the underside 75, the bag would be more secure along its base with such an underside 75 in place across the entire underside 18 of the bag 10.

Figure 7:
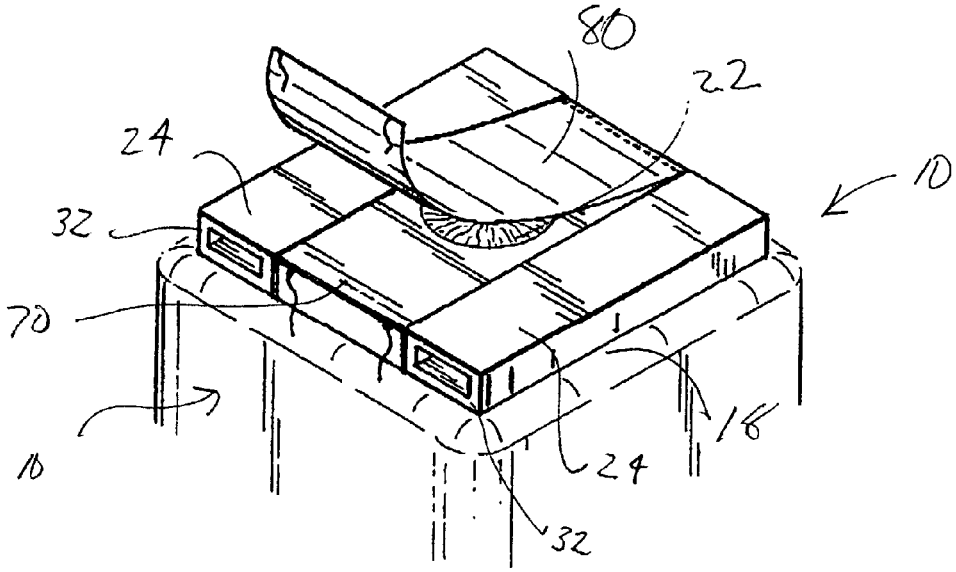
FIG. 7 illustrates an underside view of the present invention embodying a cover for the opening in the floor portion a bulk bag.
Figure 6:
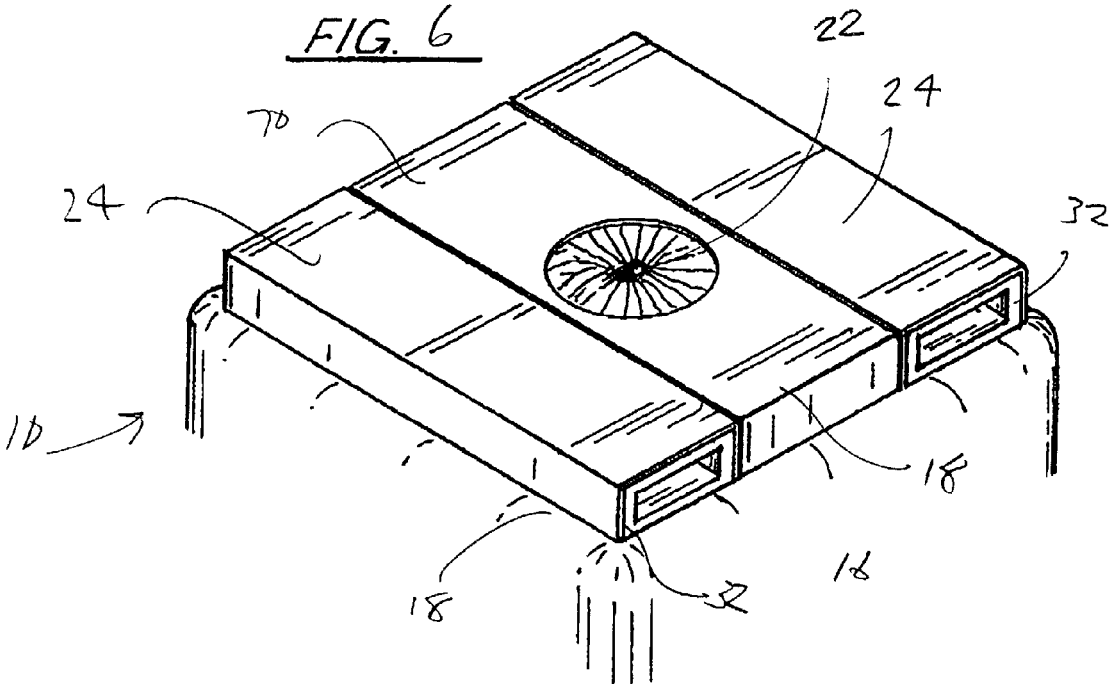
FIG. 6 illustrates an underside view of the present invention in a bulk bag having an opening in its floor portion.

Turning now to FIGS. 6 and 7, in these Figures, the bulk bag 10, which incorporates the bulk space 70 along its underside 18 would be of the type having an opening 22 in its underside 18 for allowing bulk within the bag 10 to be released from the bag 10. In FIG. 6, the underside 18 simply has the opening 22 exposed to the surface upon which it rests, between the two sleeves 24. In FIG. 7, however, there is provided a cover 80 which can be attached along the two sleeves 24, again through any means, although velcro is preferred, so that when in place the cover serves as a protective barrier between opening 22 and the surface. Of course when the product within the bag 10 is ready to be released, cover 80 is simply pulled away, as illustrated in FIG. 7, and the opening 22 is opened and bulk flows from the bag 10.

FIGS. 8 and 9 illustrate two embodiments of a prior art pallet portion 90 which may be utilized with the present invention. As illustrated, the pallet 90 includes the two spaced apart support members 32, with the undersurface 76 secured therebetween, on their lower ends, to define the pallet 90 to be used with the bulk bag of the present invention. Because the undersurface 76 is on the lower ends of the support members 32, there is defined a void 94 therebetween which would be filled with the bulk space 70, when that space is filled with bulk. Therefore, together, the two support members 32, and the bulk space 70, filling the void 100, and resting on undersurface 76 would provide a bulkbag/pallet combination 96 which would be very stable. The only difference between the two embodiments of the pallet 90 shown in FIGS. 8 and 9, is that the embodiment in FIG. 8 illustrates the pallet 90 with a central opening 92 which would be aligned with the opening 22 in the underside 18 in bulk bag 10 to allow bulk to flow therethrough when the downspout is released and bulk flows. FIG. 9 illustrates an embodiment that would be utilized with a bulk bag having no opening in its bottom wall 18, and therefore, eliminating the need for an opening in pallet undersurface 76.

Figure 10:
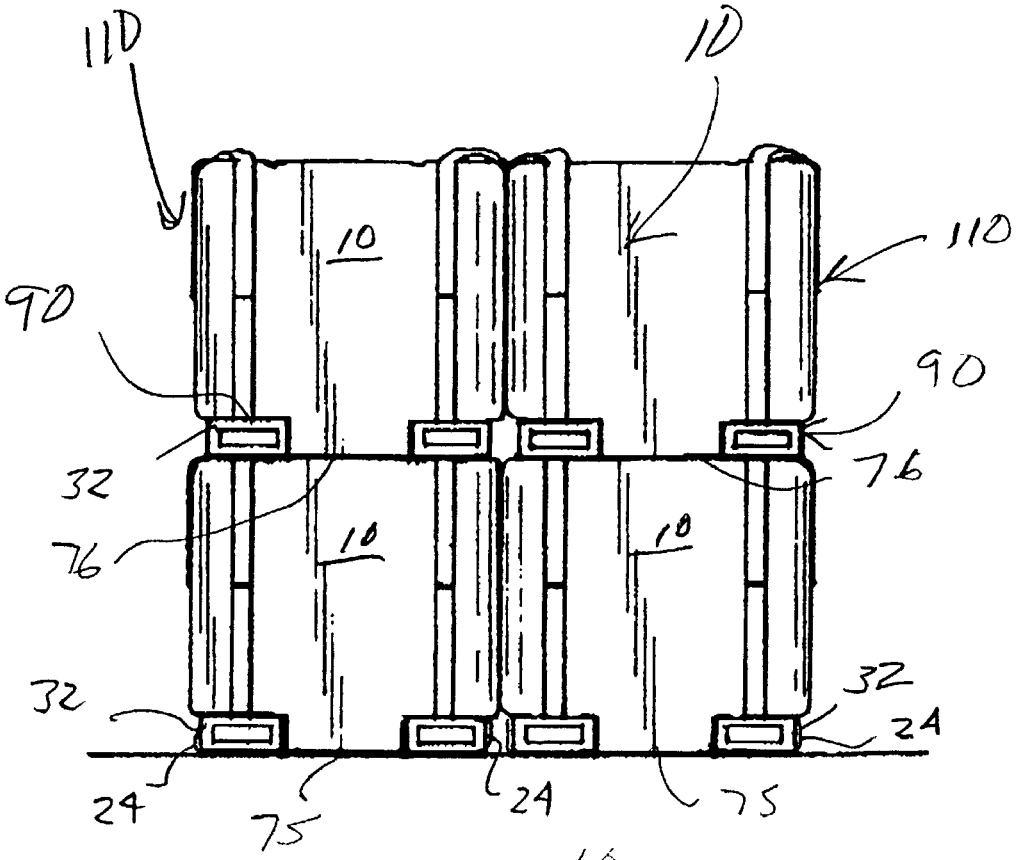
FIG. 10 illustrates a plurality of the bulk bags of the present invention stacked upon one another in rows in a rigid and secure manner.

As seen in FIG. 10, there is represented a plurality of the bulk bags 10 of the present invention stacked upon one another. The pair of lower bags 10 represent the embodiment where the support members 32 secured within the sleeves 24, and the bulk space 70 filled with bulk to define a continuous support underside 75 upon which the bags 10 rest. The pair of upper bags 10, resting on lower bags 10, represent the embodiment utilizing the integrated combination of bulk bag and pallet feature; that is, with the bulk bag 10 secured upon a, pallet 90, which is not integrated as part of bag 10, but which, when the bulk has filled bulk space 70, allows the bag 10 to rest on pallet 90, with the bulk space 70 nested between support members 32, and undersurface 76 extending between the members 32, to define a solid base upon which the upper bags 10 are supported.

For purposes of construction, the support members 32 would be injection molded high density polyethylene (HDPE), or be formed of some other suitable, equivalent material, but in each case sufficiently strong to support the weight of a filled bulk bag, yet geometrically shaped to strengthen the members 32 against deflection; and each side wall have a 10 degree angle to strengthen the walls against uneven floors. Also, the corners of each of the members 32 are rounded to allow the members 32 to easily inserted into sleeves 24 without snagging the fabric. The foregoing embodiments are presented by way of example only; the scope of the present invention is to be limited only by the following claims.

FIGS. 11 through 23 illustrate additional preferred embodiments of the container system of the present invention as illustrated by the numeral 110. As illustrated in the figures, there is depicted a bulk bag 111 having a floor portion 112 of a bulk bag 111, of the type as described in FIGS. 1 through 10, having a top portion 113 (FIG. 17), plurality of sidewalls 115. The floor portion 112 having a drop down portion 114 incorporated therein, positioned between to inserts 32 as was described earlier in FIGS. 1 through 10. It should be noted for purposes of construction, the drop down portion 114, which as illustrated, has a pair of side walls 116, 118 and opposing end walls 120, 124, which are stitched to form the rectangular drop down portion 114. The upper edges 126 of the drop down portion would be stitched to the bottom portion 112 of the bulk bag to define the composite floor portion 112 with the drop down portion 114 incorporated therein, as illustrated.

It should be noted that when dry bulk material is delivered into the bulk bag during filling, usually from a spout on the upper wall, the bulk material, of course fills the lower end of the bulk bag, with the drop down portion 114 receiving the bulk initially. As more bulk is poured into the bag, the weight of the bulk tends to force the end walls 120, 124 and side walls 116, 118 outward, attempting to reform the drop down portion from the rectangular shape as illustrated to a circular shape. When this occurs, the expansion of the side walls 116, 118 begin to impinge on the inserts or support members 32, and cause the members to disorient so that the members 32 are not lying flat. This presents difficulties in the tines of a forklift entering the spaces 35 within the members 32 to lift the bag. Furthermore, an even more difficult problem is that the shorter end walls 120, 124 will bulge outwards in the direction of arrows 130, which causes high stress on the bag's fabric wall at the point above the stitch line to the drop down portion. This stress will result in a rupture of the bag wall, which, of course, is very undesirable.

Figure 11:
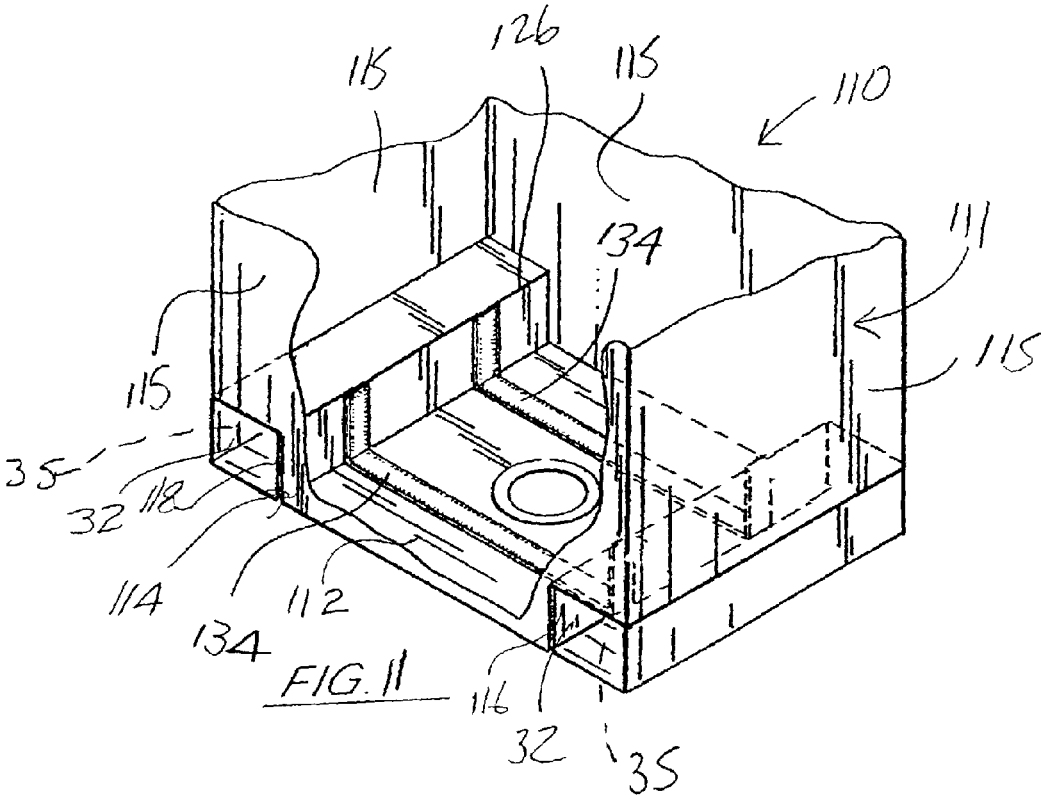
FIG. 11 illustrates a partial cutaway view of an additional embodiment of the present invention.
Figure 12:
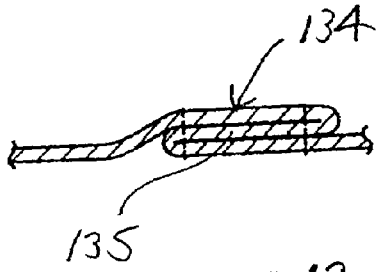
FIG. 12 illustrates an isolated view of a pleat as illustrated in FIG. 11.

FIGS. 11 and 12 illustrates one of the means for compensating for this bulging effect, and to reduce the outward bulging of end members 120, 124 which would also reduce the great stress on the fabric of the bag bottom 112 and the drop down portion 114. This means comprises a pair of pleats 134, which are formed along the sidewalls 116, 118 and the floor portion 112 of the drop down portion 114. The pleats 134, as formed, and illustrated ir isolated view in FIG. 12, take up fabric 135 along the length of the drop down portion 114, tending to force the end walls 120, 124 inward, so that when bulk is poured into the bag 110, and creates the stresses on the end walls 120, 124, as referred to earlier, the end walls 120, 124 will not be forced outwardly to the extent as would occur without the pleats 134, thus reducing the stress on the fabric of the bag.

Figure 13:
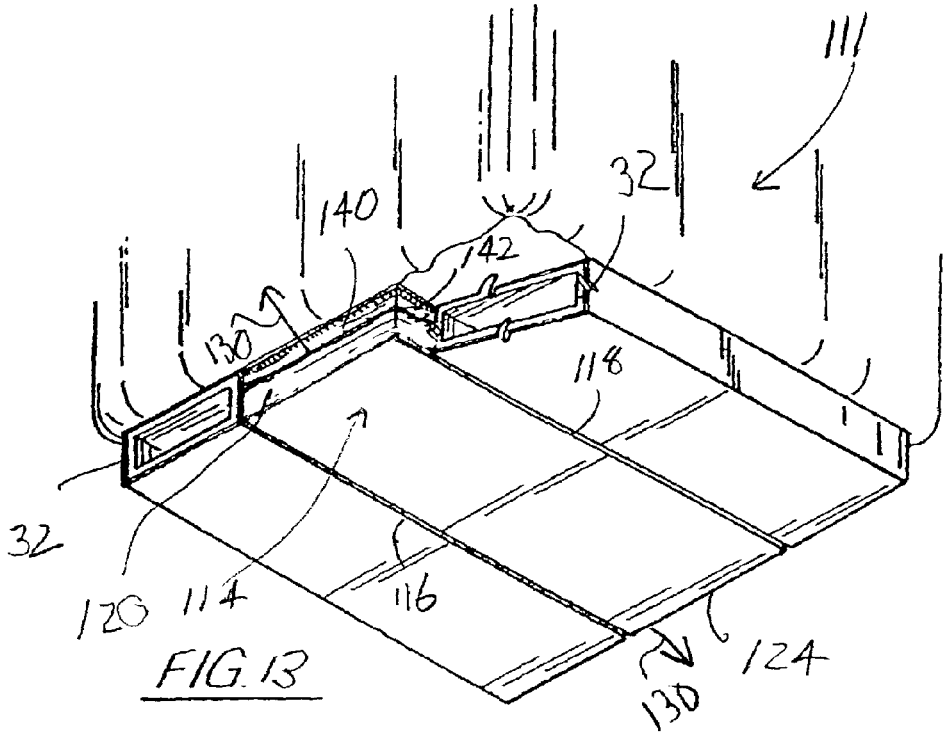
FIGS. 13 and 14 illustrates a partial cutaway view of the modified drop down portion of the bulk bag.
Figure 14:
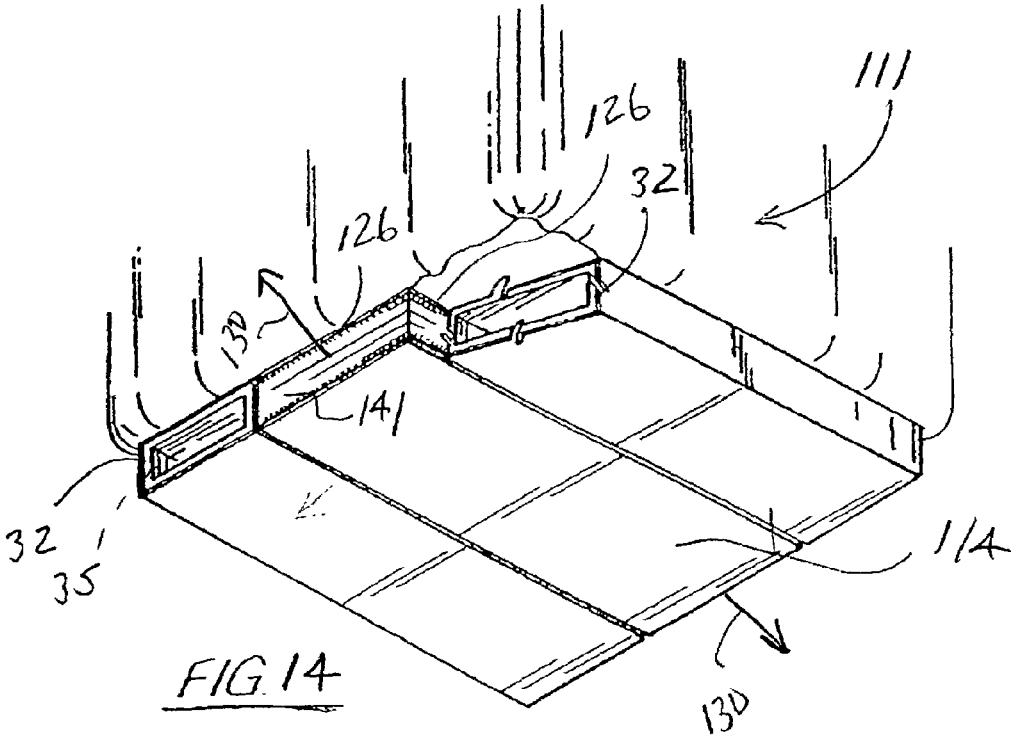

In order to provide greater strength between the stitched connection between the bag floor portion 112 and the drop down portion 114, reference is made to FIG. 13 where there is illustrated a length of reinforced material, known in the industry as webbing 140, which would be stitched along each end wall 120, 124 at the connection between the bag floor 112 and the drop down portion 114. The ends 142 of the webbing 140 would wrap around to the side walls 116, 118 and would terminate along each side wall 116, 118. In this embodiment the webbing 140 would cover only a portion of the end walls 120, 124 of the drop down portion 114. An additional option to reinforce the side walls 116, 118 and end walls 120, 124 of the drop down portion 114 of the bag, is illustrated in FIG. 14. In this configuration, there would be provided a length of webbing 141, which would be of the same width as the end walls 120, 124 of the drop down portion 114, and would be sewn in place around the entire perimeter walls of the drop down portion 114, as illustrated. Thus, when bulk material is placed therein, the reinforced webbing 141 would greatly assist in preventing the walls of the drop down portion 114 from bowing outward, and therefore minimizing the stress on the fabric of the bag.

Figure 15:
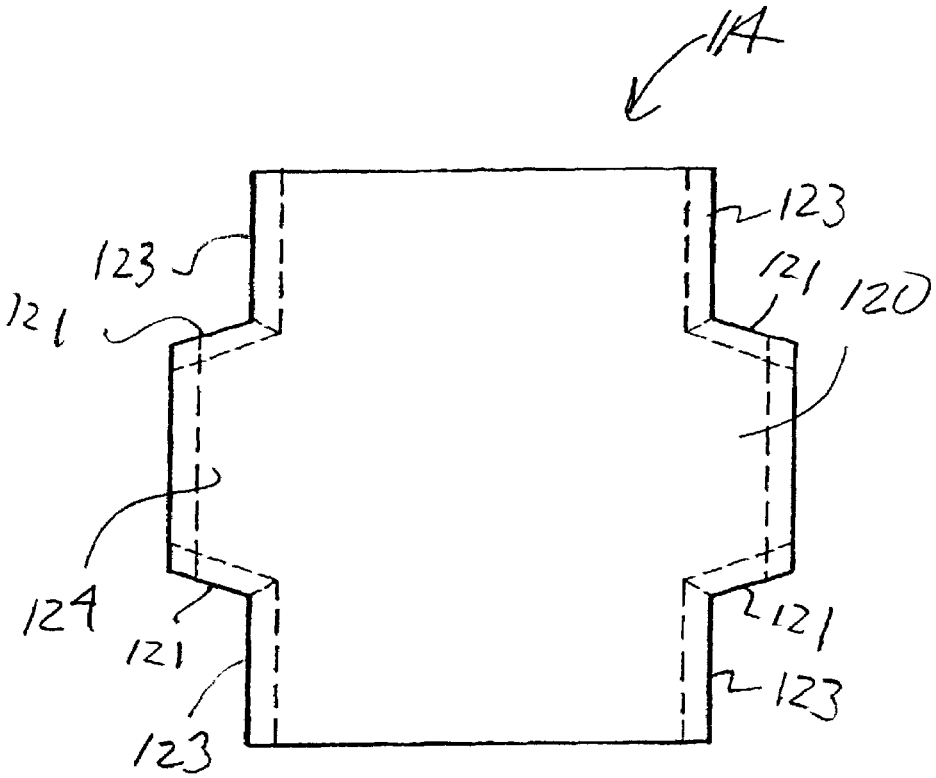
FIG. 15 illustrates an additional embodiment of the drop down portion of the bulk bag.
Figure 17:
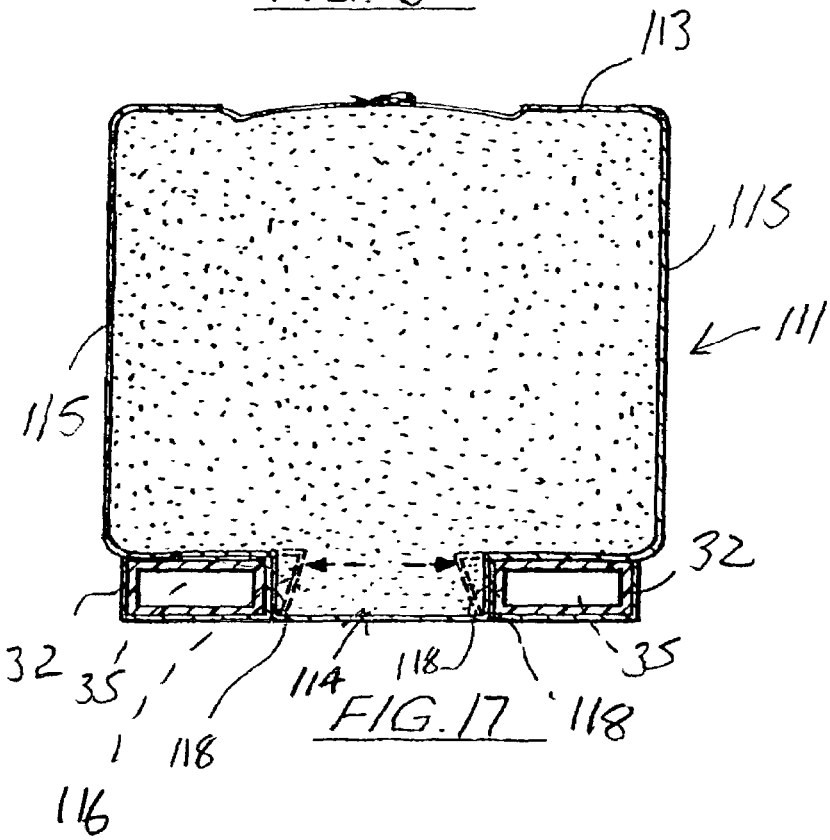
FIG. 17 illustrates a side view of a bulk bag with no lifting loops with the modified drop down portion of the bulk bag filled with bulk material.
Figure 16:
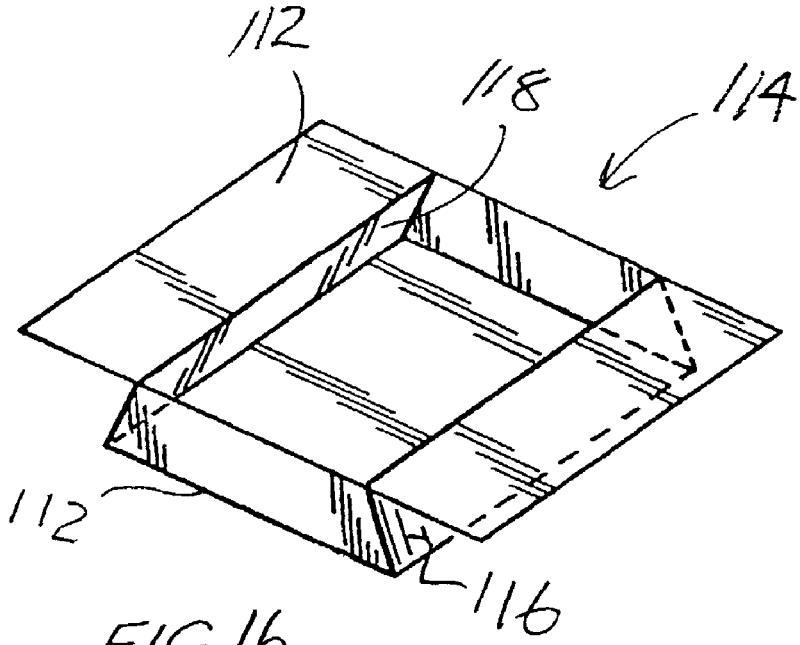
FIG. 16 illustrates a top view of the pattern of the embodiment of the drop down portion illustrated in FIG. 15.

Reference is now made to FIGS. 15 through 17 for a discussion of yet an additional means for preventing or greatly reducing the bulging of the side walls 116, 118 of the drop down portion 114. As illustrated first in FIG. 15, a top view of the drop down portion 114 is illustrated before it is sewn into the composite structure 114 that would be sewn to the bag. As illustrated, the two edges 121 of end walls 120, 124, rather than forming a 90 degree angle to the edges 123 of side walls 116, 118, the edges 121 are angulated inward, so that when the edges 121 are sewn to edges 123, the composite structure, rather than being a rectangular box, as seen in FIG. 11, would have the two end walls 120, 124 formed in a trapezoid shape, with the two side walls 116, 118 brought inward as seen in FIG. 16. The result would be that when bulk is poured into the drop down portion 114, as seen in FIG. 17, the side walls 116, 118, forming the trapezoid configuration (seen in phantom view) rather than expand outward and impinge on the two inserts 32, would move from the position inward (phantom view) to a postion either upright, or slightly bulging, to compensate for the stress caused by the bulk material. This would greatly reduce, if not totally eliminate any impingement of the side walls 116, 118 on the inserts, as was described earlier.

Figure 18:
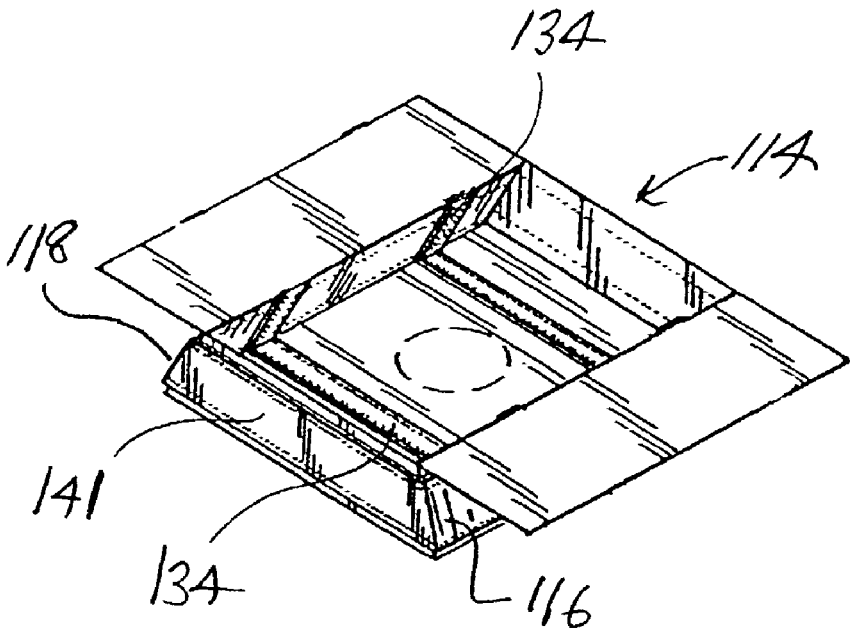
FIG. 18 illustrates the modified drop down portion of the bulk bag including the pleat features of FIG. 11.

As seen in FIG. 18, there is illustrated a combination of the pleats 134 as described for reducing stress on the side walls 116, 118, as described in FIGS. 11 and 12. In addition, there could be included the use of the reinforced webbing 140 along the end walls 120, 124, as seen in FIG. 13, or the use of the wider webbing 141 around the entire perimeter of the drop down portion 114, as seen in FIG. 14, when as used together with the trapezoid construction of the drop down portion 114, as discussed, would define the most secure drop down portion 114, which is resistant to bulging and deforming under the stress of the bulk within the bag. Of course all of the reinforcement features as discussed could be used in different combinations or independently depending on the requirements for a particular bag and its contents.

Figure 23:
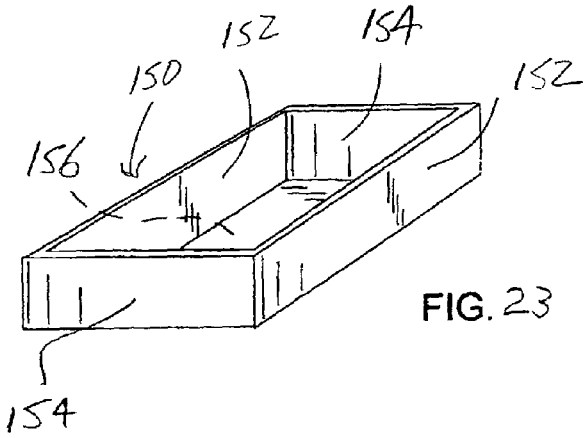
FIG. 23 illustrates a box housing for enclosing the drop down portion as bulk is poured into the bag.

An additional means for reducing the bulging of the drop down portion 114 after being filled with bulk, is illustrated in FIG. 23. In this figure there is illustrated a rectangular box 150, having sidewalls 152 and end walls 154 to define a space 156 therein. Box 150 would be substantially the same size as the dimensions of the drop down portion 114. The box 150 would be set beneath the drop down portion 114 when the bag is yet filled. Upon being filled, the drop down portion 114 would expand to the configuration of the walls of the box 150, but would be prevented from expanding further. When the bag is lifted from the box 150, although there would be some expansion of the drop down portion 114, it has been found through tests, that the expansion would be a great deal less than without the box 50, when poured into a drop down portion 114 that has not been reinforced as described in relation to FIGS. 11 through 18 above.

Figure 19:
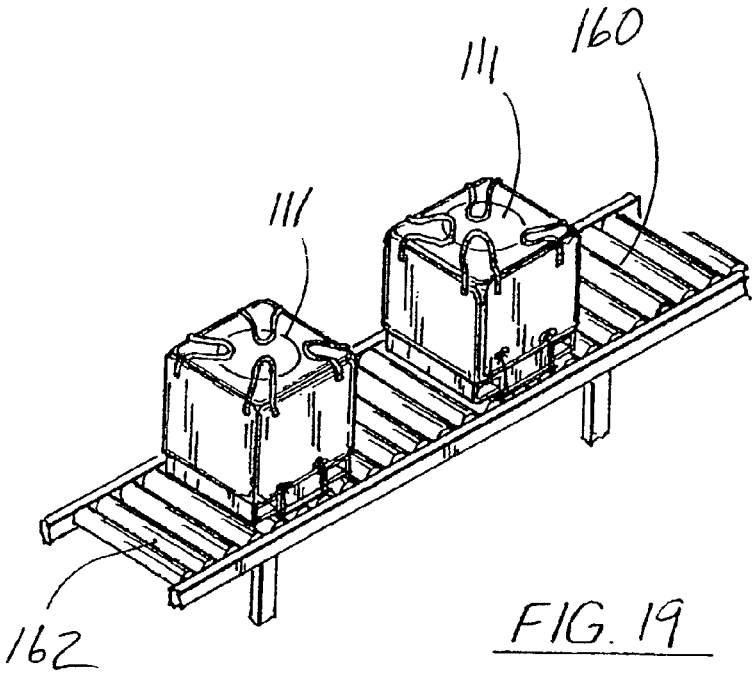
FIG. 19 illustrates a group of filled bulk bags of the type having a drop down portion set upon a roller conveyor.

The final problem which must be addressed is the problem of the drop down portion 114 expanding downward beyond the floor portions of the two inserts 32. This problem and its solution is discussed in FIGS. 19 through 22. In FIG. 19, bulk bags 111 are illustrated moving along a roller conveyor 160. A common problem occurs when the filled bulk bag 111 would be lifted and set upon the conveyor rollers 162 to be moved from one place to the next. The bulge on the bottom of the drop down portion 114 would tend to encounter the rollers 162 and would cause the bag 111 to become lodged and unable to move along the rollers 162.

Figure 20:
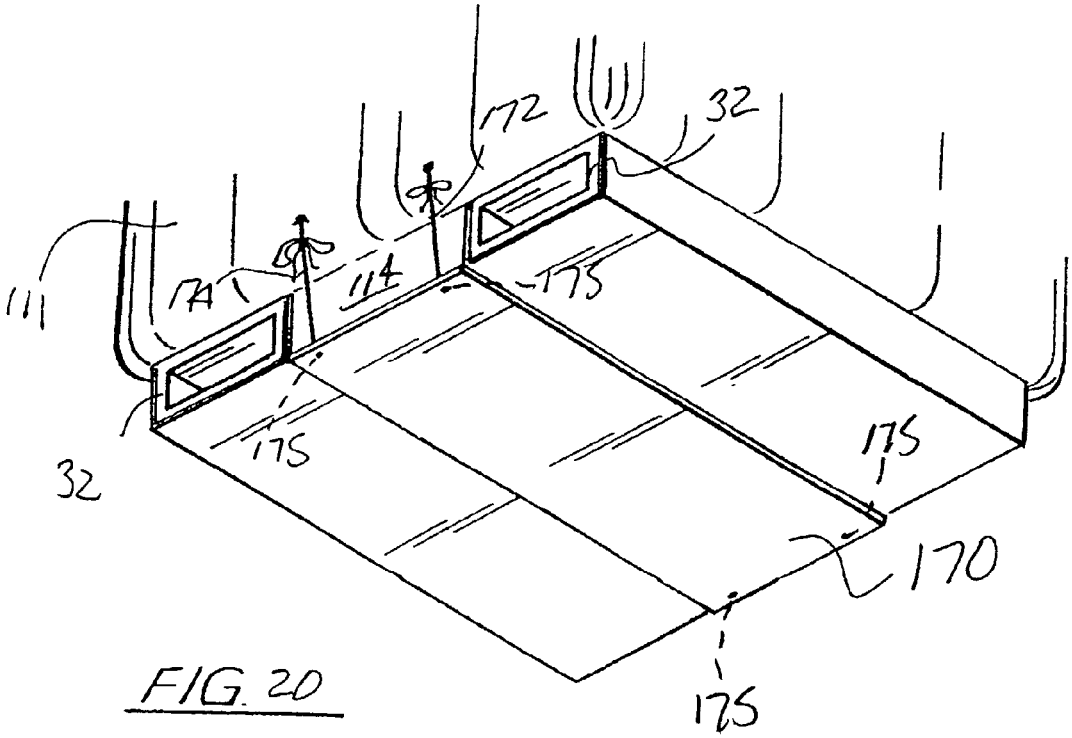
FIG. 20 illustrates a modified bulk bag having a drop down portion protective member.
Figure 21:
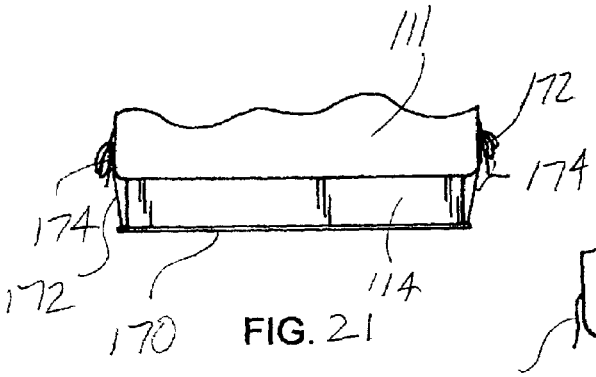
FIG. 21 illustrates a side view of the bulk bag illustrated in FIG. 20.
Figure 22:
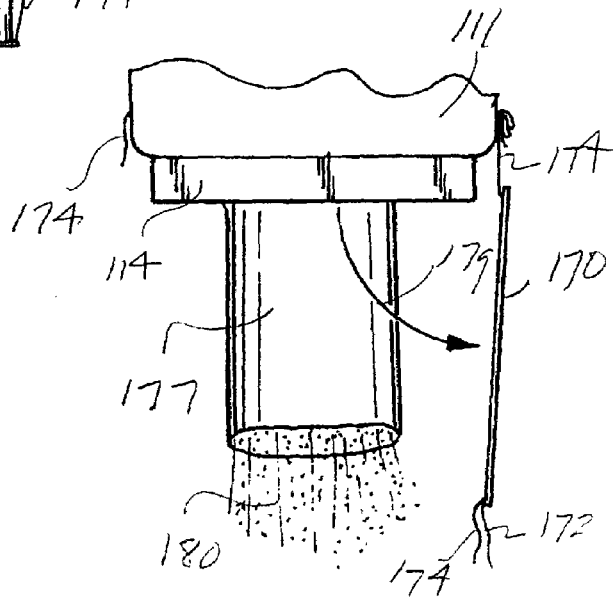
FIG. 22 illustrates a side view of the bulk bag in FIG. 21, with the protective member released from the bag.

The solution to this problem is provided in FIGS. 20 through 22. What is provided is a substanially rigid member 170, constructed of hard plastic or the like, which would be of dimensions equal to the length and width of the drop down portion 114. The member 170 would be secured to the sidewalls 115 of the bag, or walls 116, 118 of the drop down portion 114, with a pair of fabric strands 172, 174, sewn into the bag wall at a first end and threaded through openings 175 in the ends of the member 170 and tied in place. As illustrated, the length of the strands 172, 174, would allow the member 170 to hang a distance below the filled drop down portion 114 when the bag is lifted. When the bag 110 is set in place on roller conveyor 160, the member 170 would be resting on the conveyor surface, and the drop down portion 114 would rest on the inner face of the member 170, making no contact with the conveyor surface. Therefore, together with the lower surfaces of the inserts 32 and the lower surface of the member 170, the bag 111 would be resting on a flat, smooth surface and would move easily along the conveyor surface. Each bag would have such a member 170 attached; therefore, there would be no need to manually place such a member 170 beneath each bag, as each bag is set in place on the conveyor 160. Furthermore, the member 170 would define a means to provide a barrier between the lower end of the bag and the surfaces upon which the bag would rest during transport and storage. This would prevent contamination of the bag contents, and would further provide a lower surface, defined by the two inserts and the member 170 upon which the bag rests. It has been shown that this under surface provides an almost "tripod" lower end which would more easily conform to an irregular surface, since each component; i.e., the two inserts 32 and the drop down portion 114 is acting apart from the other components and would allow greater stability of the bag when placed upon another bag.

As illustrated in FIG. 22, when the contents of the bag are ready to be removed via the downspout 177, two of the strands 172, 174 would be untied from one end of the member 170, and the member 170 would swing away from the bottom of the bag (arrow 179) to allow access to the downspout to release the bag contents 180. When the bag is empty, the member 170 could returned to its full protective mode.

It is foreseen that the system as discussed in relation to FIGS. 1 through 22 provide a complete system for supporting and transporting bulk bags. It should be noted that the bulk bag 110 as illustrated in FIG. 17, has no lifting loops as would a conventional bulk bag 110. In the preferred system, there would be no use of lifting loops. The use of inserts 32 together with the drop down portion 114, as illustrated, allows the bag to be moved easily and to be set upon a surface or upon other bags, as the case may be. The carrier system as described, including the pair of inserts 32, and the manner in which the drop down portion is reinforced to maintain its rectangular configuration would define the single system of lifting and transporting the bulk bags in the system.

PARTS LIST

The following is a list of suitable parts and materials for the various elements of the preferred embodiment of the present invention.

| Part No. | Description |
|---|---|
| 10 | Fabric bulk bag |
| 14 | Top wall |
| 16 | Side wall |
| 18 | Bottom wall or underside |
| 20 | Bag space |
| 22 | Opening |
| 24 | Fabric sleeves |
| 25 | Edges |

-continued

| Part No. | Description |
|---|---|
| 26 | Opening |
| 28, 30 | Ends |
| 32 | Support member |
| 34, 36 | Ends |
| 35 | Opening |
| 70 | Bulk containing space |
| 71 | Bulk |
| 72 | Lower surface |
| 75 | Underside |
| 76 | Undersurface |
| 77 | Ties |
| 80 | Cover |
| 90 | Pallet portion |
| 92 | Central opening |
| 94 | Void |
| 96 | Bulk bag/pallet combination |
| 110 | container system |
| 111 | bulk bag |
| 112 | floor portion |
| 113 | top portion |
| 114 | drop down portion |
| 115 | side walls |
| 116, 118 | side walls |
| 120, 124 | end walls |
| 121, 123 | edges |
| 126 | upper edges |
| 130 | arrows |
| 134 | pleats |
| 135 | fabric |
| 140 | webbing |
| 141 | webbing |
| 142 | ends |
| 150 | rectangular box |
| 152 | side walls |
| 154 | end walls |
| 156 | space |
| 160 | roller conveyor |
| 162 | rollers |
| 170 | rigid member |
| 172, 174 | fabric strands |
| 175 | openings |
| 177 | down spout |
| 179 | arrow |

What is claimed is:

1. A composite bulk bag and pallet system, comprising:

a) a bulk bag of the type having side portions, an upper end portion, and a lower floor portion;

b) at least two structures placed alone the lower floor portion of the bulk bag for allowing entry of folk lift tines therein, and of sufficient strength to support the weight of the product within the bag above the structures; and c) a drop down portion of the bag between the two structures including fabric side and end wall portions and a floor portion secured to the bottom of the bag which, when filled with bulk material, will drop to floor level and together with the structures will provide additional support to the bag; and d) reinforcement webbing secured between the bag and the end portions of the drop down portion to prevent stress on the fabric which would result in rupture of the bag wall.

2. The system in claim 1, further comprising reinforcement webbing around the entire wall portions of the drop down portion to prevent the drop down portion from expanding outward as a result of outward forces of the product within the drop down portion.

3. The system in claim 1, further comprising at least one pleat formed in the side walls and floor portion of the drop down portion which would reduce the fabric length of the drop down portion in the longitudinal direction resulting in less outward expansion of the walls of the drop down portion under forces of the product.

4. The system in claim 1, further comprising the side walls, as secured to the end walls define walls which are angulated inwardly, so that upon receiving bulk into the drop down portion, the side walls expand outward to substantially vertical, which expansion would not impact the two inserts on either side of the drop down portion.

5. The system in claim 1, wherein there is further provided a rectangular container which would accommodate the drop down portion when empty, so that when the drop down portion is filled with bulk, the walls of the drop down portion configure to the walls of the rectangular container, and when the container is removed, the drop down portion maintains its rectangular shape to a certain degree.

6. A composite bulk bag and pallet system, comprising:

a) a bulk bag of the type having side portions, an upper end portion, and a lower floor portion;

b) at least two structures placed below the lower floor portion of the bulk bag for allowing entry of folk lift tines therein, and of sufficient strength to support the weight of the product within the bag above the structures;

c) a portion of the bag between the two structures that is defined as a drop down portion which, when filled with bulk material, will drop to floor level and provide additional support to the bag; and d) reinforcement webbing positioned in relation to the drop down portion for preventing the expansion of end and side walls of the drop down portion from expanding outward to such an extent to cause rupture of the bag walls or disorientation of the two structures.

7. The system in claim 6, wherein the means for preventing expansion of the end and side walls further comprises reinforcement webbing around the entire wall portions of the drop down portion to prevent the drop down portion from expanding outward as a result of outward forces of the product within the drop down portion.

8. The system in claim 6, wherein the means for preventing expansion of the end and side walls further comprises at least one pleat formed in the side walls and floor portion of the drop down portion which would reduce the fabric length of the drop down portion in the longitudinal direction resulting in less outward expansion of the walls of the drop down portion under forces of the product.

9. The system in claim 6, wherein the means for preventing expansion of the end and side walls further comprises the side walls and when secured to the end walls for defining walls which are angulated inwardly, so that upon receiving bulk into the drop down portion, the side walls expand outward to substantially vertical, which expansion would not impact the two inserts on either side of the drop down portion.

10. The system in claim 6, wherein there is further provided a rectangular container which would accommodate the drop down portion when empty, so that when the drop down portion is filled with bulk, the walls of the drop down portion configure to the walls of the rectangular container, and when the container is removed, the drop down portion maintains its rectangular shape to a certain degree.

11. The system in claim 6, further comprising a substantially rigid member configured to the shape of the drop down member, and positioned below and attached to the bag on two ends of the rigid member, and, so that when the bag filled with bulk is set upon a surface, the rigid member serves as a flat end portion of the bag, and together with the two structures, defines a support surface of the bag for storage or transport.

12. A composite bulk bag and pallet system, comprising a) a bulk bag of the type having side portions, an upper end portion, and a lower floor portion;

b) at least two structures placed below the lower floor portion of the bulk bag for allowing entry of folk lift tines therein, and of sufficient strength to support the weight of the product within the bag above the structures;

c) a portion of the bag between the two structures that is defined as a drop down portion including side and end wall portions and a floor portion, which, when filled with bulk material, will drop to floor level and provide additional support to the bag; and d) pleats formed in the vertical walls and floor of the drop down portion for preventing the expansion of the end walls of the drop down portion from expanding outward to such an extent to cause rupture of the bag walls.

13. A composite bulk bag and pallet system, comprising:

a) a bulk bag of the type having side portions, an upper end portion, and a lower floor portion;

b) at least two structures placed below the lower floor portion of the bulk bag for allowing entry of folk lift tines therein, and of sufficient strength to support the weight of the product within the bag above the structures;

c) a portion of the bag between the two structures that is defined as a drop down portion which, when filled with bulk material, will drop to floor level and provide additional support to the bag; and d) the side walls of the drop down portion being formed inwardly so that upon being filled with bulk, the side walls expand from the inward position to substantially a vertical position to avoid disorientation of the rigid support members.

14. A composite bulk bag and pallet system, comprising a) a bulk bag of the type having side portions, an upper end portion, and a lower floor portion;

b) at least two structures placed below the lower floor portion of the bulk bag for allowing entry of folk lift tines therein, and of sufficient strength to support the weight of the product within the bag above the structures;

c) a portion of the bag between the two structures that is defined as a drop down portion which, when filled with bulk material, will drop to floor level and provide additional support to the bag; and d) a reinforced webbing sewn along at least the end walls of the drop down portion for preventing the expansion of the end walls of the drop down portion from expanding outward to such an extent to cause rupture of the bag walls.

15. A composite bulk bag and pallet system, comprising:

a) bulk bag of the type having side portions, an upper end portion, and a lower floor portion;

b) at least two structures placed below the lower floor portion of the bulk bag for allowing entry of folk lift tines therein, and of sufficient strength to support the weight of the product within the bag above the structures;

c) a portion of the bag between the two structures that is defined as a drop down portion which, when filled with bulk material, will drop to floor level and provide additional support to the bag;

d) pleats formed in the drop down portion to prevent outward expansion of the walls of the drop down portion; and e) a substantially rigid member configured to the shape of the drop down portion, and positioned below and attached to the bag on two ends of the rigid member, and, so that when the bag filled with bulk is set upon a surface, the rigid member serves as a flat end portion of the bag, and together with the two structures, define a support surface of the bag for storage or transport.

16. An improved bulk bag transport system, comprising: a bulk bag of the type having side portions, an upper end portion, and a lower floor portion, comprising:

a) a pair of rigid support members positioned along the width of an undersurface of the lower floor portion, and spaced sufficiently apart to each accept a tine of a forklift therein; and b) a portion of the lower floor portion formed between the pair of rigid support members having side and end walls and defining a drop down portion, so that when the bag contains sufficient bulk, the drop down formed between the pair of rigid support members is filled with bulk material and, together with the rigid support members, defines a support surface for the bulk bag;

c) a pair of pleats formed in the drop down portion to prevent excessive outward expansion of the end walls of the drop down portion; and d) the side walls being formed inwardly so that upon being filled with bulk, the side walls expand from the inward position to substantially a vertical position to avoid disorientation of the rigid support members.

17. An improved bulk bag of the type having side portions, an upper end portion, and a lower floor portion, comprising:

a) a pair of rigid support members positioned along the width of an undersurface of the lower floor portion, and spaced sufficiently apart to each accept a tine of a forklift therein; and b) a portion of the lower floor portion formed between the pair of rigid support members having side and end walls and defining a drop down portion, so that when the bag contains sufficient bulk, the drop down formed between the pair of rigid support members is filled with bulk material and, together with the rigid support members, defines a support surface for the bulk bag;

c) a pair of pleats formed in the drop down portion to prevent excessive outward expansion of the end walls of the drop down portion; and d) a continuous band of reinforced webbing surrounding the outside of the end and side walls of the drop down portion to prevent outward expansion of the walls when the drop down portion is filled with bulk material.

18. The improved bulk bag in claim 17, wherein there may be provided a flat surface member extending between the underside of the two support members.

19. The system in claim 18, wherein the side walls of the drop down portion are formed inwardly so that upon being filled with bulk, the side walls expand from the inward position to substantially a vertical position to avoid disorientation of the rigid support members.

20. The improved bulk bag in claim 18, wherein the support member further includes a flat top portion, positioned against the bag's lower floor portion, and a pair of side walls extending downward therefrom for receiving the forklift tines therebetween.

21. An improved pallet support system supporting a fabric bulk bag of the type having side portions, an upper end portion, a lower floor portion, and a drop down portion connected to the lower floor portion, the system comprising:

a) a pair of rigid support members positioned along the width of an undersurface of the lower floor portion, and spaced sufficiently apart to each accept a tine of a forklift therein and to accommodate the drop down portion therebetween;

b) a substantially rigid surface member engaged between the lower surfaces of the two support members so that when the bag contains sufficient bulk, the drop down portion connected to the floor portion will occupy the space between the pair of rigid support members and will rest on the rigid surface member, and, together with the rigid support members, will define a lower support surface for the bulk bag; and c) pleats formed in the drop down portion to prevent excessive outward expansion of the end walls of the drop down portion.

* * * * *